US007161299B2

(12) United States Patent
Yoo

(10) Patent No.: US 7,161,299 B2
(45) Date of Patent: Jan. 9, 2007

(54) STRUCTURE FOR A PLASMA DISPLAY PANEL THAT REDUCES CAPACITANCE BETWEEN ELECTRODES

(75) Inventor: Sung-Hune Yoo, Asan-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 147 days.

(21) Appl. No.: 10/927,345

(22) Filed: Aug. 27, 2004

(65) Prior Publication Data

US 2005/0140579 A1 Jun. 30, 2005

(30) Foreign Application Priority Data

Sep. 8, 2003 (KR) ..... 10-2003-0062545

(51) Int. Cl.
*H01J 17/49* (2006.01)

(52) U.S. Cl. ..... 313/586; 313/587

(58) Field of Classification Search ..... 313/582–587
See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,786,794 | A | 7/1998 | Kishi et al. | |
| 5,952,782 | A | 9/1999 | Nanto | |
| 6,160,345 | A * | 12/2000 | Tanaka et al. | 313/489 |
| RE37,444 | E | 11/2001 | Kanazawa | |
| 6,630,916 | B1 | 10/2003 | Shinoda | |
| 6,707,436 | B1 | 3/2004 | Setoguchi et al. | |
| 6,888,310 | B1 * | 5/2005 | Tadaki et al. | 313/586 |
| 2004/0113555 | A1 * | 6/2004 | Han et al. | 313/586 |
| 2005/0228112 | A1 * | 10/2005 | Takahashi et al. | 524/497 |

FOREIGN PATENT DOCUMENTS

| | | |
|---|---|---|
| JP | 02-148645 | 6/1990 |
| JP | 2845183 | 10/1998 |
| JP | 2917279 | 4/1999 |
| JP | 2001-043804 | 2/2001 |
| JP | 2001-325888 | 11/2001 |
| KR | P1999-0027578 A | 4/1999 |
| KR | P2001-0097300 | 11/2001 |

OTHER PUBLICATIONS

Korean Office Action issued by the Korean Patent Office in applicant's corresponding Korean Patent Application No. KR 10-2003-0062545, issued on Jul. 25, 2005.

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

* cited by examiner

*Primary Examiner*—Mariceli Santiago
*Assistant Examiner*—Anne M Hines
(74) *Attorney, Agent, or Firm*—Robert E. Bushnell, Esq.

(57) ABSTRACT

A design for a plasma display panel that both reduces the capacitance between adjacent address electrodes while improving the optical characteristics of the display. This is achieved by having a layer formed on the rear substrate over the address electrodes being made of two separately patterned substances. The two substances have different dielectric constants while different optical properties. Preferably, the visible light generated in the phosphor layer of the display is reflected off the layer formed over the rear substrate and then transmitted through the front substrate.

20 Claims, 4 Drawing Sheets

STRUCTURE FOR A PLASMA DISPLAY PANEL THAT REDUCES CAPACITANCE BETWEEN ELECTRODES

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on Sep. 8, 2003 and there duly assigned Serial No. 2003-62545.

BACKGROUND OF THE INVENTION

1. Field of the Invention

The present invention relates to a plasma display panel and more particularly, to a plasma display panel having an improved structure which can reduce a capacitance between address electrodes is during addressing, to thereby decrease power consumption and increase displaying efficiency.

2. Description of the Related Art

Generally, a plasma display panel is configured in such a manner that a glow discharge is created when a gas is filled between two electrodes placed in a tightly closed space and a predetermined voltage is applied to them. Ultraviolet rays produced during the glow discharge activate a phosphor layer formed in a predetermined pattern, thus forming a visible image.

Such a plasma display panel is divided into direct-current, alternating-current, and hybrid types. According to the number of electrodes, the panel may have at least two electrodes or three electrodes for glow discharge. For the direct-current type, an auxiliary electrode is added, and for the alternating-current type, an address electrode is employed to enhance address speed while selective and sustain discharges are split.

According to the disposition of electrodes for glow discharge, the alternating-current type may be classified into opposing electrode and surface-discharge electrode types. In the opposing electrode structure, two sustain electrodes for creating the glow discharge are placed on a front substrate and a rear substrate, respectively, so that the glow discharge is formed along the vertical axis of the panel. In the surface-discharge electrode structure, the two sustain electrodes are located on the same substrate so that the glow discharge is created on a single substrate.

However, when signals are applied to an address electrode, an unwanted capacitance can occur between the electrodes. Further, the substrate may also not adequately transmit or adequately reflect visible optical light produced in the phosphor layers. What is needed is a design for a plasma display panel that reduces the capacitance between the electrodes while improving the optical characteristics of the constituent components of the plasma display panel.

SUMMARY OF THE INVENTION

It is therefore an object of the present invention to provide an improved design for a PDP.

It is also an object of the present invention to provide a design for a PDP that reduces capacitance between adjoining address electrodes.

It is further an object of the present invention to provide a design for a PDP that reduces absorption of the visible images formed in the PDP and transmitted to an outside.

It is still an object of the present invention to provide a structure for a PDP that simultaneously reduces capacitance between address electrodes while reducing the absorption of the produced visible images.

These and other objects may be achieved by a design for a PDP having a rear dielectric layer formed on the rear substrate underneath the barrier ribs and underneath the discharge cells. The rear dielectric layer is formed of a first dielectric layer and a second dielectric layer formed on a single layer. The second dielectric layer complements a patterned first dielectric layer to form the rear dielectric layer on a single layer.

The first dielectric layer is formed in a striped pattern beneath the barrier ribs, between adjacent discharge cells, and between adjacent address electrodes. The second dielectric layer is formed to fill in the remaining spaces of the rear dielectric layer left over after the formation and patterning of the first dielectric layer. Therefore, the second dielectric layer is also formed in a striped pattern, is formed underneath the discharge cells, is formed above the address electrodes, and is formed between adjacent barrier ribs. The first dielectric layer is formed of a material having a lower dielectric constant than the second dielectric layer. The second dielectric layer has a high reflectivity while the first dielectric layer has a low reflectivity. By forming the rear dielectric layer this way, the capacitance between adjacent address electrodes can be reduced while improving on the optical efficiency by simultaneously reflecting most of the visible light produced in the discharge cells.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
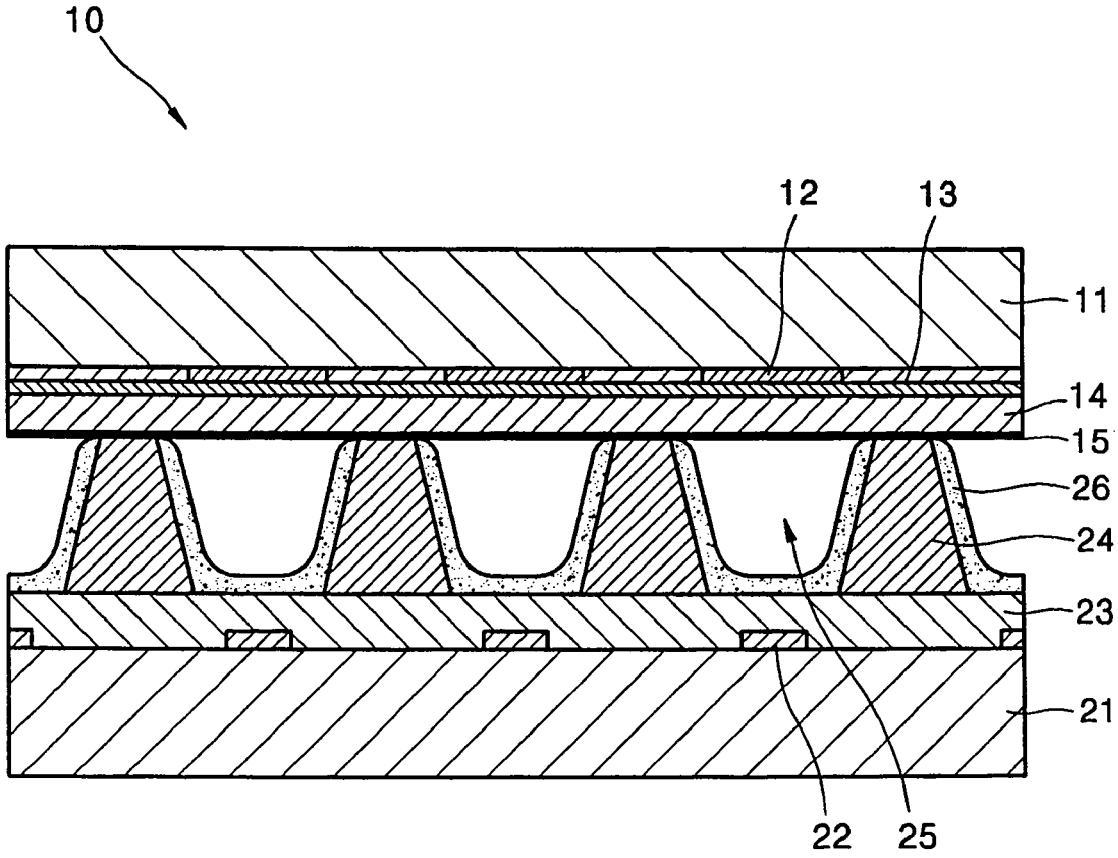
FIG. 1 is a partially sectional view of one example of a plasma display panel.

Turning now to the figures, FIG. 1 is one example of a plasma display panel 10. Referring to FIG. 1, a front substrate 11 is placed in the upper part of a plasma display panel 10, and a pair of sustain electrodes 12 respectively having predetermined widths and heights and common and scan electrodes are formed on the bottom of the front substrate 11.

Bus electrodes 13 for applying a voltage are respectively formed on the bottom of the sustain electrodes 12. The sustain electrodes 12 and the bus electrodes 13 are covered by a front dielectric layer 14, and a protective layer 15 is formed on the bottom of the front dielectric layer 14.

The rear substrate 21 is disposed to be opposite the front substrate 11. Address electrodes 22 of predetermined widths and heights are formed on the rear substrate 21. The rear substrate 21 and the address electrodes 22 are covered by the rear dielectric layer 23.

Above the rear dielectric layer 23, barriers 24 are formed for partitioning discharge spaces 25 and preventing cross-talking between adjacent discharge spaces 25. A discharge gas is filled in the discharge spaces 25. Each discharge space has a phosphor layer 26 which displays one color among red, green, and blue.

Substantially the same material such as glass powder for manufacturing the rear substrate 21 may be used to increase the transmissivity of the rear dielectric layer 23. However, glass powder in the rear dielectric layer 23 decreases the performance of the panel 10 because a large quantity of visual light generated in the phosphor passes through the rear dielectric layer 23.

To overcome such a drawback, there has been presented a method in which titanium dioxide $TiO_2$ is added to the material of the rear dielectric layer to increase whiteness and the reflectivity of the rear dielectric layer. Technology related to titanium dioxide is disclosed in Japanese patent publication No. 2003-112947.

One drawback of using titanium dioxide in the rear dielectric layer is that titanium dioxide is conductive and when uniformly and homogeneously added to the rear dielectric layer, a dielectric constant of the dielectric layer generally increases as a whole. Along with the trend of fine pitch, a distance between address electrodes is reduced to increase the capacitance there between during addressing. The capacitance between adjacent address electrodes is $C=\in A/d$ where $\in$ is the dielectric constant of the material between the electrodes and d is the distance between the electrodes. Using titanium dioxide as the rear dielectric layer, the dielectric constant $\in$ is high and the distance between the electrodes d is low resulting in a high capacitance C. Accordingly, the panel's power efficiency decreases, lowering the displaying efficiency.

Figure 2:
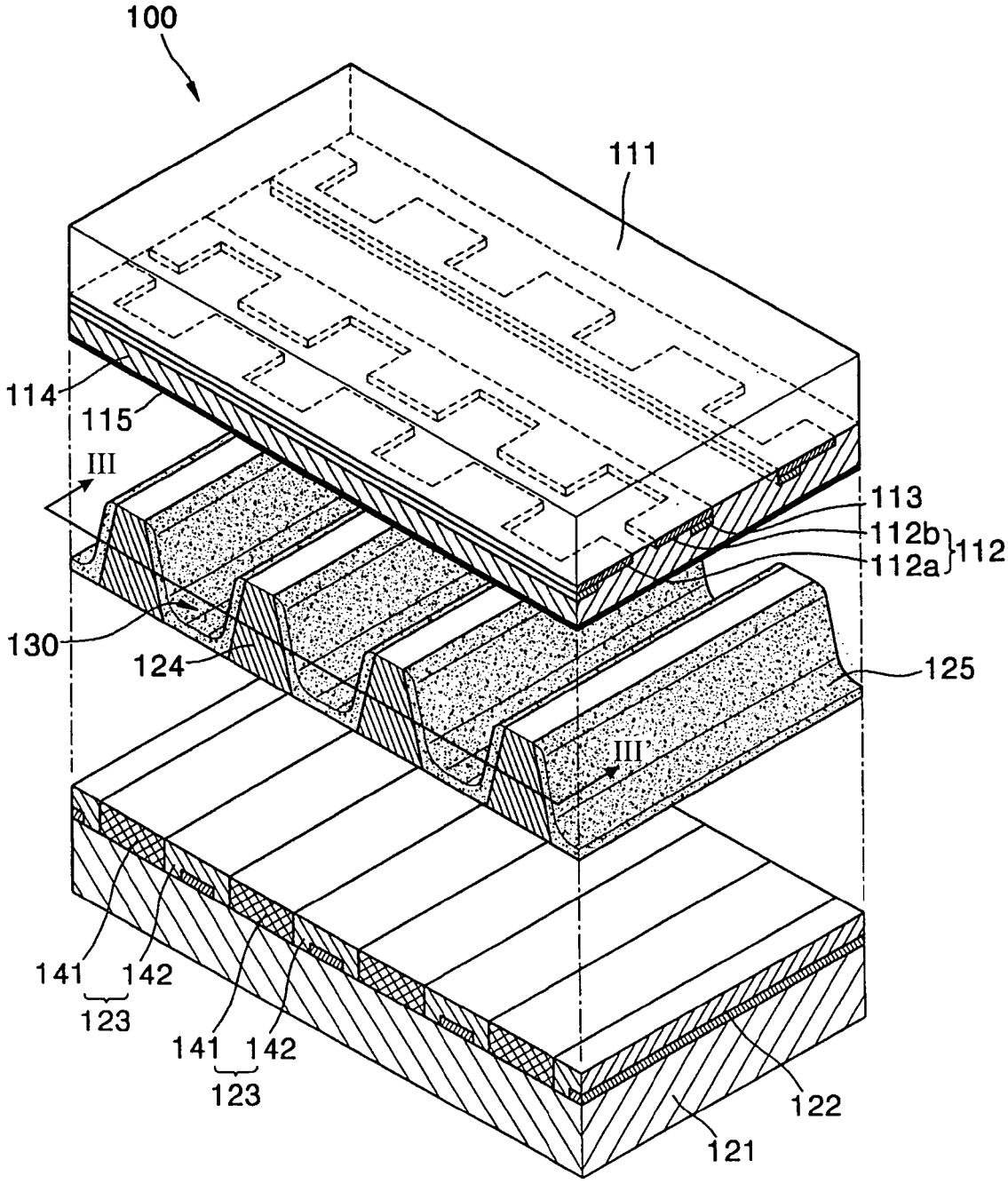
FIG. 2 is an exploded perspective of a plasma display panel according to an embodiment of the present invention.
Figure 3:
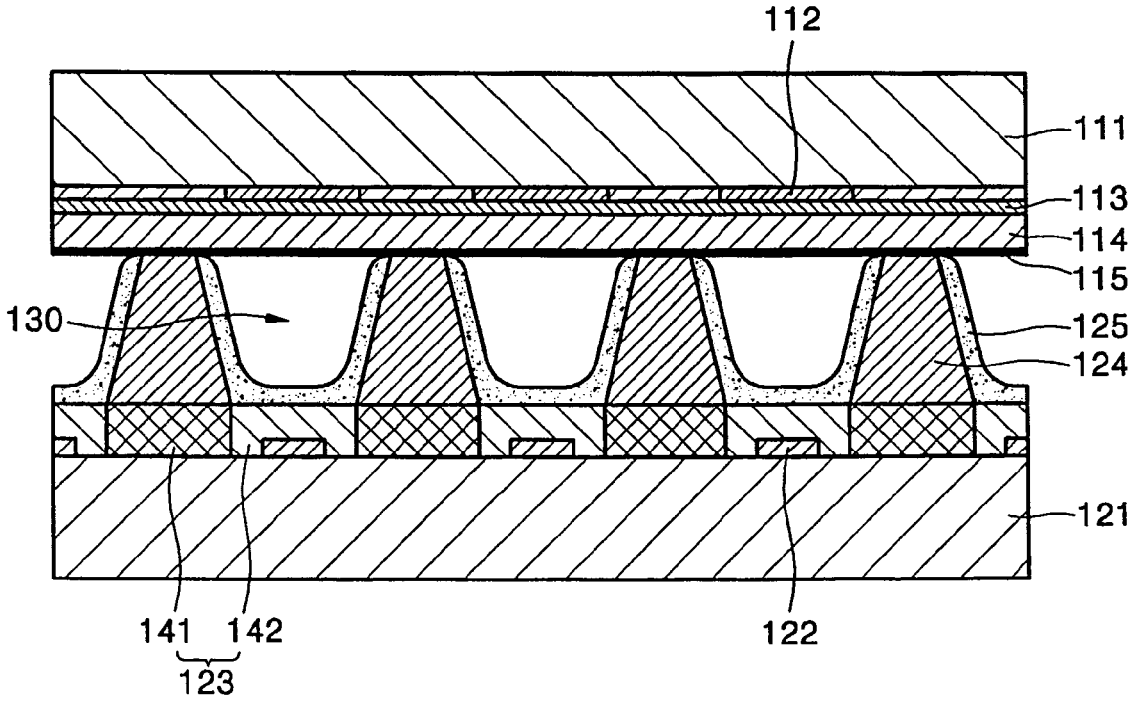
FIG. 3 is a partially sectional view of the plasma display panel of FIG. 2.

Turning now to FIGS. 2 and 3, FIGS. 2 and 3 illustrate plasma display panel (PDP) 100 according to an embodiment of the present invention. Referring to FIGS. 2 and 3, a plasma display panel 100 includes a front substrate 111 made of glass or transparent material, and a rear substrate 121 installed opposite the front substrate 111. FIG. 3 is a cross sectional view of the PDP 100 in FIG. 2 taken along the III–III' direction.

Below the front substrate 111, sustain electrodes 112 and bus electrodes 113 are formed. The sustain electrodes 112 may be formed of a transparent conductive material, for example, an ITO film on the bottom surface of the front substrate 111. The sustain electrodes 112 are cut in portions corresponding to barriers 124, and have protrusions spaced at a predetermined distance along the electrode. However, the sustain electrodes are not confined to the above shape and may be formed in various shapes, for instance, stripes.

The sustain electrodes 112 are made up of common electrodes 112*a* and scan electrodes 112*b*, which are alternately arranged in pairs. The protrusions of the common electrodes 112*a* and the scan electrodes 112*b* are opposingly arranged, the common electrodes 112*a* and scan electrodes 112*b* being spaced apart from one another by a predetermined discharge gap.

Conductive bus electrodes 113 are formed in parallel on the bottom of the sustain electrodes 112, and have a smaller width than the sustain electrodes 112. Here, the bus electrodes 113 may be formed of a material having an excellent conductivity, for instance, a conductive material containing a silver paste as its main component. However, the bus electrodes 113 may be omitted.

The sustain electrodes 112 are covered by the front dielectric layer 114 on the bottom of the front substrate 111. A protective layer 115, for instance, a magnesium oxide (MgO) film, is formed on the bottom of the front dielectric layer 114. The rear substrate 121 is disposed to be opposite the front substrate 111.

Address electrodes 122 are formed on the top of the rear substrate 121, and are covered by the rear dielectric layer 123. The rear dielectric layer 123 is the main feature of the present invention. The specifics regarding the rear dielectric layer 123 will be explained later. The address electrodes 122 are formed in a striped shape and are preferably oriented perpendicular to the bus electrodes 113 and having a predetermined distance therebetween.

The barriers 124 are formed spaced a predetermined distance from each other and on the top of the rear dielectric layer 123. The barriers 124 are configured to partition discharge spaces 130 between the front substrate 111 and the rear substrate 121.

Specifically, the barriers 124 have a predetermined height and width, and are formed in parallel with the address electrodes 122. The barriers 124 are configured such that one address electrode 122 is arranged between two barriers 124 and vice versa. In each discharge space, the common electrode 112*a* and the scan electrode 112*b* of the sustain electrode 112 form a pair, and the protruding portions of these electrodes are separated by a discharge gap. The barriers 124 are not confined to the above structure and may be formed in any structure to split the discharge spaces into a predetermined arranged pattern of pixels.

Phosphor layers 125 are respectively disposed in the discharge space 130 between the barriers 124. The phosphor layer 125 is designed to cover the inner side of the barriers 124 and the top side of the rear dielectric layer 123. For the phosphor layers 125, red, green and blue phosphors are employed. Three phosphor layers containing one red phosphor layer, one green phosphor layer, and one blue phosphor layer 125 constitute one group.

The rear dielectric layer 123 is formed between the rear substrate 121 containing address electrodes 122 thereon and the barriers 124 with the discharge spaces 130. The rear dielectric layer 123 is patterned with a first dielectric layer 141 corresponding to the bottom of the barrier 124, and with a second dielectric layer 142 for covering the address electrode 122, the second dielectric 142 being placed below the discharge space 130.

Specifically, the first and second dielectric layers 141 and 142 are disposed alternately on the same plane or on the same layer 123 and thus complement one another. The first dielectric layer 141 is formed in parallel with the barrier 124, with the second dielectric layer 142 is parallel with the address electrode 122. In the present invention, the material in the first dielectric layer 141 differs from the material in the second dielectric layer 142 in both the degree of whiteness and in dielectric constant.

For instance, the first and second dielectric layers 141 and 142 may both contain a white pigment to increase their reflectivity, and the dielectric constant and an amount of the white pigment in the first dielectric layer 141 are desirably lower than that for the second dielectric layer 142.

In one embodiment of the present invention, to make the dielectric constants and the degree of whiteness between the material used for the first and second dielectric layers 141 and 142 different from each other, the first dielectric layer 141 can contain anatase-structured titanium dioxide while the second dielectric layer 142 instead contains rutile-structured titanium dioxide.

Since the dielectric constant $\in_1$ of anatase-structured titanium dioxide and the dielectric constant $\in_2$ of rutile-structured titanium dioxide are 31 and 114 respectively, the dielectric constant of the first dielectric layer 141 containing anatase-structured titanium dioxide may be lower than that of the second dielectric layer 142 containing rutile-structured titanium dioxide.

When the content of the anatase-structured titanium dioxide in the first dielectric layer is equal to the content of rutile-structured titanium dioxide in the second dielectric layer 142, the degree of whiteness of the first dielectric layer 141 is lower than the degree of whiteness of the second dielectric layer 142, as indicated empirically in the following TABLE 1:

TABLE 1

| | Anatase-structured titanium dioxide | Rutile-structured titanium dioxide |
|---|---|---|
| Average withstand voltage | 728.5 V | 669.5 V |
| Minimum withstand voltage | 575.5 V | 455.3 V |
| Average withstand voltage per thickness | 49.3 V/□ | 46.2 V/□ |
| Degree of whiteness | 71.35 | 76.43 |

Referring to TABLE 1 above, it is confirmed empirically that the withstand voltage of the first dielectric layer 141 containing anatase-structured titanium dioxide is higher than that of the second dielectric layer 142 containing rutile-structured titanium dioxide, but the degree of whiteness of the first dielectric layer 141 containing anatase-structured titanium dioxide is lower than the degree of whiteness of the second first dielectric layer 142 containing rutile-structured titanium dioxide.

The differences in the dielectric constants and in the degrees of whiteness between the first and second dielectric layers 141 and 142 may be adjusted by varying the content ratio of the anatase-structured titanium dioxide contained in the first dielectric layer 141 to that of the rutile-structured titanium dioxide contained in the second dielectric layer 142.

In another embodiment of the present invention, the first dielectric layer 141 is made of a transparent dielectric material containing no white pigment while the second dielectric layer 142 is made of a dielectric material containing white pigment, resulting in the first and the second dielectric layers 141 and 142 having different dielectric constants as well as different degrees of whiteness. In such an embodiment, the first dielectric layer 141 has as a high optical transmissivity because it does not contain white pigment, but the optical reflectivity of the second dielectric layer 142 is higher because of the presence of the white pigment contained therein. Also, the dielectric constant $\in_1$ of the first dielectric layer 141 may become lower than the dielectric constant $\in_2$ of the second dielectric layer 142.

With regard to the rear dielectric layer 123 including the first and second dielectric layers 141 and 142, the first dielectric layer 141, having a lower dielectric constant than that of the second dielectric layer 142, is preferably disposed between adjacent second dielectric layers 142. Since the address electrode 122 is covered by the second dielectric layer 142 and the first dielectric layer 141 having a lower dielectric constant than that of the second dielectric layer 142 is arranged between the address electrodes 122 as opposed to on top of the address electrodes 122, it is expected that the capacitance C between adjacent address electrodes 122 is lower than the PDP 10 illustrated in FIG. 1 where only one material is used for the rear dielectric layer.

Unlike the second dielectric layer 142 which is located below the discharge space 130, the first dielectric layer 141 hardly influences the visible light emitted from the phosphor layer 125 because it not disposed near a discharge space 130 but is instead disposed below barrier 124. For this reason, the degree of whiteness of the first dielectric layer 141 may be lower than that of the second dielectric layer 142, or the first dielectric layer 141 may not contain a white pigment. Since the second dielectric layer 142 has a higher degree of whiteness than that of the first dielectric layer 141, the reflectivity at which the visible light emitted from the phosphor layer 125 can be sufficiently reflected is improved by the arrangement of FIG. 2. Accordingly, the panel's power consumption is reduced and displaying efficiency is improved.

It is to be appreciated that the present invention is in no way limited to the anatase and rutile structured titanium dioxide. Alternatively, the first and second dielectric layers 141 and 142 may instead contain one of alumina ($Al_2O_3$), yttria ($Y_2O_3$), magnesium oxide (MgO), calcium oxide (CaO), tantalum oxide ($Ta_2O_5$), silicon oxide ($SiO_2$), and barium oxide (BaO) to produce the white pigment.

Figure 4:
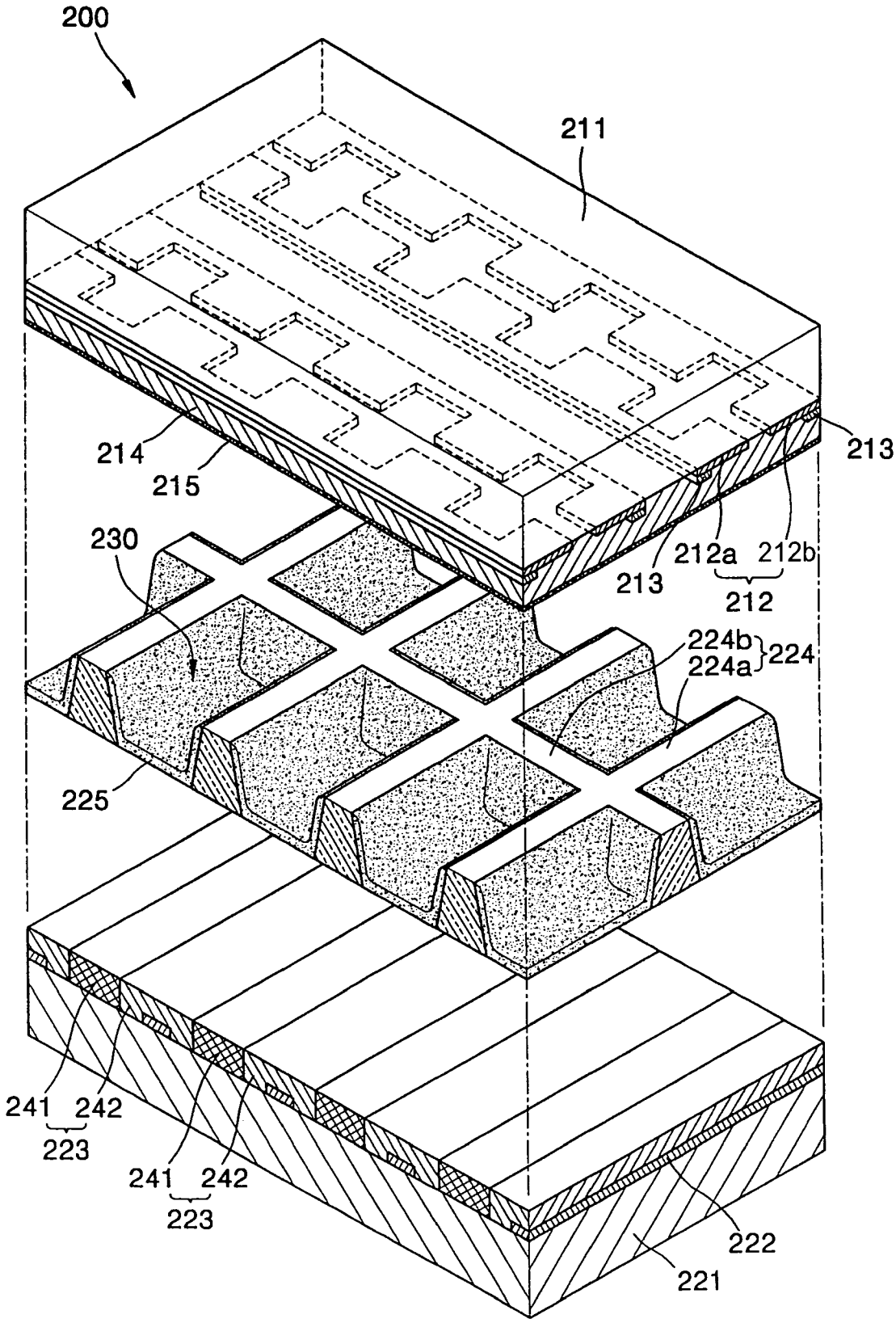
FIG. 4 is an exploded perspective of a plasma display panel according to another embodiment of the present invention.

Turning now to FIG. 4, FIG. 4 illustrates a PDP 200 according to yet another embodiment of the present invention. Referring to FIG. 4, as with the earlier embodiments, a plasma display panel 200 of FIG. 4 is made out of a front substrate 211 of glass or transparent material, and a rear substrate 221 opposite to the front substrate 211.

In the PDP 200 of FIG. 4, sustain electrodes 212 are formed on the bottom of the front substrate 211, and striped bus electrodes 213 having a narrower width than that of the sustain electrodes 212 are formed on the bottoms of sustain electrodes 212. Here, the sustain electrodes 212 are made of a transparent ITO film, and the bus electrodes 213 may be formed of a more conductive material.

The sustain electrodes 212 connected to the bus electrodes 213 are cut in portions corresponding to barriers. Preferably, the sustain electrodes 212 include common electrodes 212*a* and scan electrodes 212*b*, where a predetermined discharge gap separates the common electrodes 212*a* from the scan electrodes 212*b*. Also, each of the common electrodes 212*a* and the scan electrodes 212*b* have protrusions separated by a predetermined distance along the electrode. It is to be appreciated that the sustain electrodes 212 are not in any way limited to the above configuration, and may, for example, be formed with the same width. The common electrodes 212*a* and scan electrodes 212*b* are alternately arranged in pairs while spaced by a predetermined discharge gap. The sustain electrodes 212 and the bus electrodes 213 are covered by the front dielectric layer 214. A protective layer 215 is then formed over the bottom of the front dielectric layer 214.

Address electrodes 222 are formed on the top of the rear substrate 221 on a side of the rear substrate 221 that faces front substrate 211. The side of the rear substrate 211 with the address electrodes 222 is then covered by the rear dielectric layer 223. It is this rear dielectric layer 223 that is the main feature of the present invention. The specifics of this rear dielectric layer 223 will be explained later.

The address electrodes 222 are formed in a striped shape and separated from each other by a predetermined distance. The address electrodes 222 are preferably oriented to be orthogonal to the sustain electrodes 212 and the bus electrode 213. It is to be appreciated that the present invention is in no way limited by the above configuration.

The barriers 224 are formed in matrix (two dimensional or grid like) arrangement on the rear dielectric layer 223, and act to partition discharge spaces 230 between the front and rear substrates 211 and 221. In PDP 200 of FIG. 4, the barriers 224 are divided into first barriers 224*a* spaced apart at a predetermined distance from each other and formed in a striped shape, and second barriers 224*b* which intersect the first barriers 224*a*. Here, the first barriers 224*a* are disposed in parallel with the address electrodes 222. The second barriers 224*b* are integrally formed with the first barriers 224*a* and desirably made of substantially the same material as the first barriers 224*a*. It is to be appreciated that the present invention is in no way limited to the barrier arrangement illustrated in FIG. 4 as the barriers can also be formed in any structure to split the discharge spaces 230 in predetermined arrangement pattern of pixels.

The address electrodes 222 are located below each discharge space 230 and are split by the first and second barriers 224*a* and 224*b*. Above the discharge space 230, the common electrode 212*a* and the scan electrode 212*b* of the sustain electrode 212 are located having a predetermined discharge gap therebetween above the discharge space 230. This configuration allows discharge between the address electrodes 222 and the sustain electrodes 212. The bus electrodes 213 respectively connected to the sustain electrodes 212 are desirably placed to correspond to the second barriers 224*b*, thus enhancing an aperture rate. A phosphor layer 225 is formed in each discharge space 230 partitioned by the first and second barriers 224*a* and 224*b*.

The rear dielectric layer 223 is placed below the first and second barriers 224*a* and 224*b* and also below the discharge spaces 230. It is this rear dielectric layer 223 that is a main feature of the present invention.

The rear dielectric layer 223 is patterned with a first dielectric layer 241 corresponding to the bottom of the first barrier 224*a*, and with a second dielectric layer 242 covering the address electrode 222 and being located below the discharge space 230.

Specifically, the first and second dielectric layers 241 and 242 are disposed alternately on the same plane. The first dielectric layer 241 is formed in parallel with the first barrier 224*a*, with the second dielectric layer 242 being in parallel with the address electrode 222. Here, the degrees of whiteness and dielectric constants of the first and second dielectric layers 241 and 242 are respectively different from each other.

For instance, when the first and second dielectric layers 241 and 242 contain a white pigment to increase their reflectivity, the dielectric constant and the degree of whiteness of the white pigment in the first dielectric layer 241 are desirably lower than the dielectric constant and the degree of whiteness of the second dielectric layer 242.

To make the dielectric constant and the degrees of whiteness of the first and second dielectric layers 241 and 242 different from one another, the white pigments in the first dielectric layer 241 may be made of anatase-structured titanium dioxide while the white pigments in the second dielectric layer 242 may be made of rutile-structured titanium dioxide. The differences between the dielectric constants and the degrees of whiteness between the first and second dielectric layers 241 and 242 can be adjusted by adjusting the content ratio of the anatase-structured titanium dioxide contained in the first dielectric layer 241 and the rutile-structured titanium dioxide contained in the second dielectric layer 242.

In another embodiment of the present invention, the first dielectric layer 241 is made of a transparent dielectric material containing no white pigment while the second dielectric layer 242 is made of a dielectric material containing white pigment. With such an arrangement, the degrees of whiteness and the dielectric constants of the first and second dielectric layers 241 and 242 are different from each other. Specifically, the first dielectric layer 241 has as a high transmissivity since it does not have any white pigment, but the reflectivity of the second dielectric layer 242 is higher because of the white pigment contained therein. The dielectric constant of the first dielectric layer 241 is preferably lower than that of the second dielectric layer 242 since the first dielectric layer 241 is entirely located between adjacent address electrodes 222.

With regard to the rear dielectric layer 223 having first and second dielectric layers 241 and 242, the first dielectric layer 241, having a lower dielectric constant than that of the second dielectric layer 242 is preferably disposed between adjacent stripes of second dielectric layers 242. Since the address electrode 222 is covered by the second dielectric layer 242 and the first dielectric layer 241 having a lower dielectric constant than that of the second dielectric layer 242 is arranged between the address electrodes 222, it is expected that the capacitance C between the address electrodes 222 during addressing to be smaller than that of the PDP 10 of FIG. 1 where the rear dielectric layer uniformly contains white pigment.

Unlike the second dielectric layer 242 which is located underneath the discharge space 230, the first dielectric layer 241 hardly influences the visible light generated in the phosphor layer 225 because first dielectric layer 241 is located only between the discharge spaces 230 and not underneath the discharge spaces 230. For this reason, the degree of whiteness of the first dielectric is layer 241 is preferably lower than that of the second dielectric layer 242, or, alternatively, the first dielectric layer 241 may not contain any white pigment at all. Since the second dielectric layer 242 has a higher degree of whiteness than that of the first dielectric layer 241, the reflectivity at which the visible light emitted from the phosphor layer 225 can be sufficiently reflected is improved. Accordingly, the panel's power consumption is reduced and displaying efficiency is improved.

The white pigment contained in the first and second dielectric layers 241 and 242 is in no way limited to titanium dioxide but instead may be one of alumina ($Al_2O_3$), yttria ($Y_2O_3$), magnesium oxide (MgO), calcium oxide (CaO), tantalum oxide ($Ta_2O_5$), silicon oxide ($SiO_2$), and barium oxide (BaO), as in the PDP 100 of FIG. 2.

As described above, since the rear dielectric layers according to the embodiments of the present invention are respectively placed below phosphor layers and barriers having different degrees of whiteness and dielectric constants, the rear dielectric layers have increased reflectivity and reduced capacitance between the address electrodes during addressing. Accordingly, the panel's invalid power consumption is reduced and its displaying efficiency is enhanced.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display panel, comprising:

a front substrate comprising a plurality of sustain electrodes spaced a predetermined distance from one another;

a front dielectric layer covering the sustain electrodes;

a rear substrate arranged opposite to the front substrate, the rear substrate comprising a plurality of address electrodes that are orthogonal to the plurality of sustain electrodes;

barriers formed between the front and rear substrates, and defining discharge spaces;

phosphor layers formed respectively in the discharge spaces; and a rear dielectric layer comprising a first dielectric layer placed below each barrier, and further comprising a second dielectric layer arranged above the address electrodes and placed below each discharge space, wherein a degree of whiteness and a dielectric constant of the first dielectric layer is different from that of the second dielectric layer.

2. The plasma display panel of claim 1, wherein a degree of whiteness in the first dielectric layer is less than a degree of whiteness of the second dielectric layer, and wherein a dielectric constant of the first dielectric layer is smaller than the dielectric constant of the second dielectric layer.

3. The plasma display panel of claim 1, the first dielectric layer comprising anatase-structured titanium dioxide and the second dielectric layer comprising rutile-structured titanium dioxide.

4. The plasma display panel of claim 3, each of the first dielectric layer and the second dieletric layer comprises a white pigment, the first dielectric layer having a lower white pigment content than the second dielectric layer.

5. The plasma display panel of claim 1, the first dielectric layer being an optically transparent dielectric material and the second dielectric layer comprising a white pigment.

6. The plasma display panel of claim 1, wherein the barriers being striped at a predetermined distance from each other to form the discharge spaces, the first dielectric layer being formed in parallel with address electrodes, the second dielectric layer being formed between the first dielectric layers.

7. The plasma display panel of claim 1, wherein the barriers are formed in a matrix arrangement to partition the discharge spaces, the first dielectric layer being formed along the barriers in parallel with the address electrodes, the second dielectric layer being formed along the address electrodes.

8. The plasma display panel of claim 1, the first and second dielectric layers comprising a material selected from the group consisting of ($Al_2O_3$), yttria ($Y_2O_3$), magnesium oxide (MgO), calcium oxide (CaO), tantalum oxide ($Ta_2O_5$), silicon oxide ($SiO_2$) and barium oxide (BaO).

9. A plasma display panel, comprising:

a front substrate comprising a plurality of sustain electrodes spaced a predetermined distance from one another;

a front dielectric layer covering the sustain electrodes;

a rear substrate arranged opposite to the front substrate, the rear substrate comprising a plurality of address electrodes that are orthogonal to the plurality of sustain electrodes;

barriers formed between the front and rear substrates, and defining discharge spaces;

phosphor layers formed respectively in the discharge spaces; and a rear dielectric layer comprising a first dielectric layer placed below each barrier, and further comprising a second dielectric layer arranged above the address electrodes and placed below each discharge space, wherein the first dielectric layer being an optically transparent dielectric material and the second dielectric layer being an optically reflective material.

10. The plasma display panel of claim 9, wherein the first dielectric layer comprises anatase-structured titanium dioxide.

11. The plasma display panel of claim 10, wherein a content of titanium dioxide contained in the first dielectric layer is equal to or less than a content of titanium dioxide contained in the second dielectric layer.

12. A plasma display panel of claim 9, wherein the barriers are striped at a predetermined distance to partition the discharge spaces, the first dielectric layer being formed in parallel with and between the address electrodes, the second dielectric layer being formed over the address electrodes on the same layer as the first dielectric layer.

13. The plasma display panel of claim 9, wherein the barriers are formed in a matrix arrangement to partition the discharge spaces, the first dielectric layer being formed in parallel with and between the address electrodes, the second dielectric layer being formed over the address electrodes on the same layer as the first dielectric layer.

14. The plasma display panel of claim 9, the second dielectric layer comprising rutile-structured titanium dioxide.

15. A plasma display panel, comprising:

a front substrate comprising a plurality of sustain electrodes spaced a predetermined distance from one another;

a front dielectric layer covering the sustain electrodes;

a rear substrate arranged opposite to the front substrate, the rear substrate comprising a plurality of address electrodes that are orthogonal to the plurality of sustain electrodes;

barriers formed between the front and rear substrates, and defining discharge spaces;

phosphor layers formed respectively in the discharge spaces; and a rear dielectric layer arranged over the rear substrate and over the address electrodes formed on the rear substrate, the rear dielectric layer comprising a first dielectric layer and a second dielectric layer both patterned on a single layer, the first dielectric layer being formed between adjoining address electrodes, the first dielectric layer having a lower dielectric constant than the second dielectric layer.

16. The plasma display panel of claim 15, the second dielectric layer being patterned to complement the first dielectric layer.

17. The plasma display panel of claim 15, the second dielectric layer being arranged beneath the discharge spaces and having a high optical reflectivity.

18. The plasma display panel of claim 17, the first dielectric layer being optically transmissive.

19. The plasma display panel of claim 15, the first and the second dielectric layers each comprising titanium dioxide.

20. The plasma display panel of claim 15, the second dielectric layer comprising a material selected from the group consisting of ($Al_2O_3$), yttria ($Y_2O_3$), magnesium oxide (MgO), calcium oxide (CaO), tantalum oxide ($Ta_2O_5$), silicon oxide ($SiO_2$) and barium oxide (BaO).

* * * * *